US005320442A

United States Patent [19]

Yanagisawa et al.

[11] Patent Number: 5,320,442

[45] Date of Patent: Jun. 14, 1994

[54] LIQUID APPLICATOR WITH ONE WAY DRIVE

[75] Inventors: Katsuhiko Yanagisawa, Hachioji; Hiroto Nehashi, Tokyo, both of Japan

[73] Assignee: Ikeda Corporation, Tokyo, Japan

[21] Appl. No.: 35,963

[22] Filed: Mar. 23, 1993

[51] Int. Cl.[5] ..... A45D 40/20; A45D 40/06; A45D 34/00

[52] U.S. Cl. ..... 401/172; 401/23; 401/24; 401/34; 401/174; 401/266; 401/271; 401/288

[58] Field of Search ..... 401/70, 171, 172, 288, 401/266, 75, 174, 20, 23, 24, 34, 271

[56] References Cited

U.S. PATENT DOCUMENTS 416,659 3/1889 Wells et al. ..... 401/172
4,560,297 12/1985 Leem ..... 401/75

FOREIGN PATENT DOCUMENTS 436110 6/1948 Italy ..... 401/174
666082 2/1952 United Kingdom ..... 401/172
1279839 6/1972 United Kingdom ..... 401/172
2197783 6/1988 United Kingdom ..... 401/172
2203031 10/1988 United Kingdom ..... 401/174

*Primary Examiner*—Steven A. Bratlie
*Attorney, Agent, or Firm*—Nikaido, Marmelstein, Murray & Oram

[57] ABSTRACT

A liquid applicator structure which has an application tip fixed to front end of a cylindrical body and a liquid supply assembly built in its rear end. The liquid supply assembly includes a rotatable rod composed of a cylindrical shank-and-operating end and a solid rod having male threads thereon. The rotatable rod is held with an anti-rotation member having a cantilever-like extension. A split slide member having two split extensions is engaged with the rotatable rod at its rear end. One of these split extensions is inserted within the cantilever-like extension of the anti-rotation member and the rotatable rod, thereby preventing the split slide member from rotating. A piston member abuts on the split slide member. Rotation of the rotatable rod causes the split slide member and the piston to advance and drive liquid toward the application tip.

5 Claims, 6 Drawing Sheets

LIQUID APPLICATOR WITH ONE WAY DRIVE

BACKGROUND OF THE INVENTION

1. Field of the Invention

The present invention relates to a device for applying a viscous liquid in the form of gel such as rouge or other cosmetic liquids.

2. Description of Related Art

A lipstick is contained in a container, and a desired length of lipstick is driven helically forward to appear from the container to be applied to the lips, and is driven helically backward to withdraw in the container after use. This operation is less convenient. Brushes are used in applying liquid rouge. Clear applications of the rouge to the lips cannot be easily performed. This is the same with the application of other cosmetic liquids such as those used in manicuring, eyeliners or eyebrow pencils.

In an attempt to solve the problem of the inconvenience in applying such cosmetic liquids, Japanese Utility Model 64-2705(A); 1-65680(A) and 1-69680(A) proposed improved applicators. These applicators use a hollow cylindrical liquid container having an application tip on its front end. A piston is slidably fitted in the hollow cylindrical liquid container, and is fixed to a screw rod in the cylinder, and the screw rod is fixed to a rotatable rear piece, which closes the rear end of the cylinder. Rotation of the rear piece will cause the piston to advance forward, thereby driving the liquid toward the application tip.

However, the screw drive mechanisms of these conventional applicators are complicated, and accordingly such applicators are relatively expensive. Also, the application tips of such applicators are found not to be appropriate for the purpose of applying viscous liquids.

SUMMARY OF THE INVENTION

One object of the present invention is to provide an applicator for applying gel-like liquids with ease.

Another object of the present invention is to provide a viscous liquid applicator whose parts can be so easily assembled to the applicator, and accordingly which is appropriate for mass production.

Still another object of the present invention is to provide a viscous liquid applicator which is capable of applying different kinds of liquids ranging from low to high viscosity type.

To attain these objects, a liquid applicator comprises a cylindrical body having an application tip fixed to its front end and a liquid supply assembly built in its rear end, the cylindrical body being filled with a liquid to be applied between the application tip and the liquid supply assembly. The liquid applicator is improved according to the present invention in that the liquid supply assembly incorporates a rotatable rod including a cylindrical shank-and-operating end and a solid rod integrally connected thereto and having male threads thereon; an anti-rotation member having a shortened cylindrical end fixed to the rear end of the cylindrical body and a cantilever-like extension integrally connected to the shortened cylindrical end; means to permit the rotatable rod to rotate only in one direction; a split slide member having two split extensions, whose rear ends have female threads in their inner surfaces, one of the two split extensions being inserted in the cantilever-like extension of the anti-rotation member and the rotatable rod, thereby preventing the split slide member from rotating; and a piston member abutting on the split slide member, whereby rotation of the rotatable rod causes the split slide member and hence, the piston to advance and drive the liquid toward the application tip.

In use rotation of the rotatable rod causes rotation of the male-threaded rod portion, and then the split slide member, which is prevented from rotating by the anti-rotation member, is driven by the male-threaded rod portion, thereby pushing the liquid toward the application tip until the application tip has been saturated with the liquid.

A plurality of longitudinally parallel grooves are made on the inner surface of the shortened cylindrical end of the anti-rotation member, and a raised piece is integrally connected to the cylindrical shank of the rotatable rod whereby the raised piece is allowed to fit in the longitudinal parallel grooves one after another when the rotatable rod is rotated in one direction, preventing counter rotation of the rotatable rod.

One of the two split extensions has a flat surface on its outside whereas the cantilever-like extension of the anti-rotation member has a flat surface on its inside. Thus, the split slide member is prevented from rotating, and is allowed to advance forward when the rotatable rod is rotated.

The application tip may be a brush having a fine tube nozzle with a valve fixed to its rear end. The valve is responsive to pressure applied by the advancing split slide member via the liquid for opening and allowing liquid to flow in the fine tube nozzle. This arrangement has the effect of preventing the excessive oozing of liquid of low viscosity from the application tip.

The application tip may be of silicone resin or urethane, and may have a channel or liquid passage therein. This has the effect of assuring the oozing of liquid of medium and high viscosity from the application tip.

The application tip may be of a soft resin material such as silicone rubber, and may have a round tip and at least one through aperture made in a circular circumference on the round tip and at least one arc slot communicating with the through aperture, leaving a cylindrical portion at its center. Such arc slots can store liquid enough to permit application of the liquid to a relatively large area.

Other objects and advantages of the present invention will be understood from the following description of liquid applicators according to preferred embodiments of the present invention, which are shown in accompanying drawings.

DESCRIPTION OF THE PREFERRED EMBODIMENTS

Figure 1:
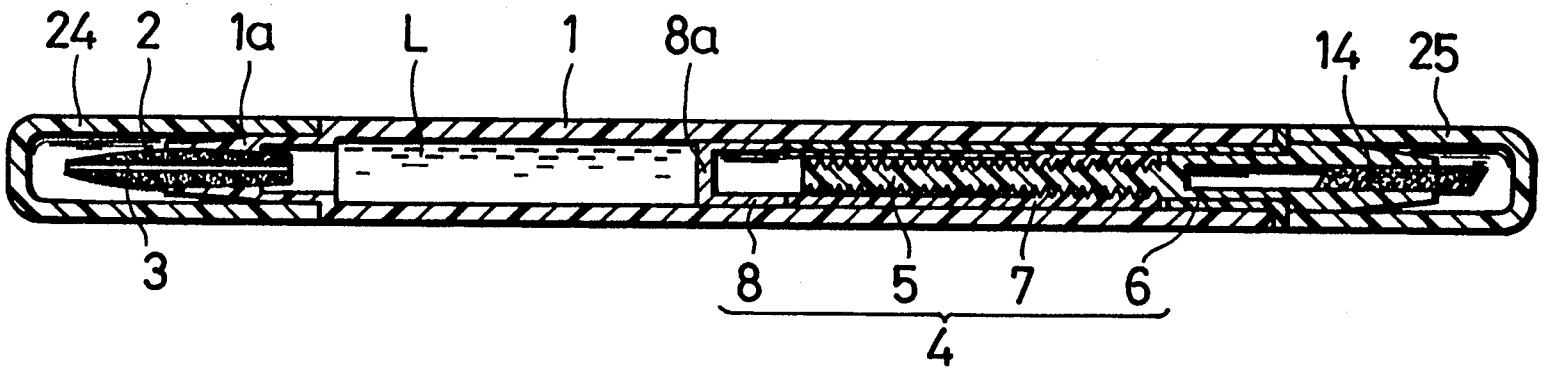
FIG. 1 is a longitudinal section of a liquid applicator according to one embodiment of the present invention.

Referring to FIG. 1, a liquid applicator 1 is composed of an elongated, pencil-like cylindrical body which is filled with a liquid L to be applied. As shown, a tapered hollow portion 1*a* is integrally connected to the front end of the elongated cylinder, and an application tip 2 is press-fitted in the tapered hollow portion 1*a*. The application tip 2 is a bundle of polyester or nylon filaments, and it has a tapering shape to facilitate application of the liquid. The tapering bundle of filaments has a fine longitudinal channel 3 along its center axis.

Figure 2:
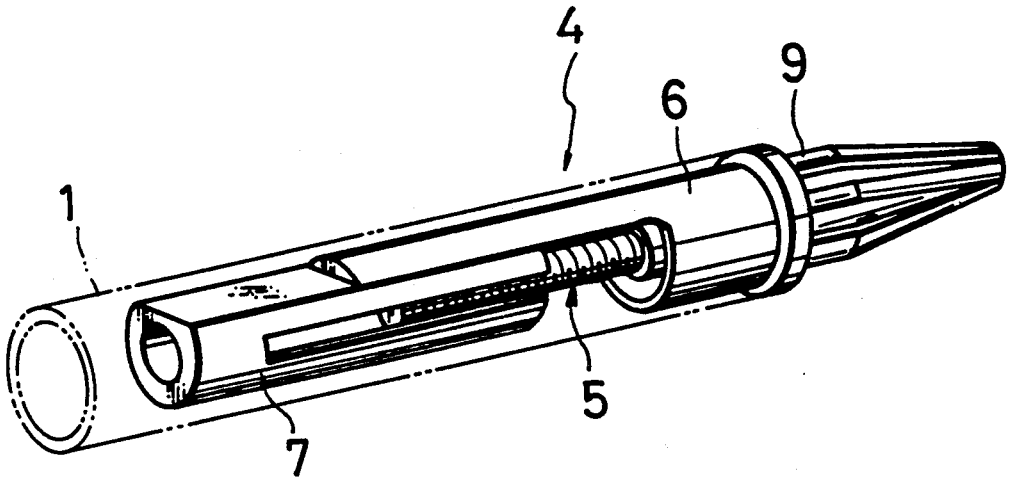
FIG. 2 is a perspective view of the liquid supply mechanism of the liquid applicator of FIG. 1.

The pencil-like cylindrical body 1 has a liquid supply assembly 4 built in its rear end, as best seen in FIG. 2. The liquid supply assembly 4 is composed of a rotatable rod 5, an anti-rotation member 6, a split slide member 7 and a piston 8.

Figure 3:
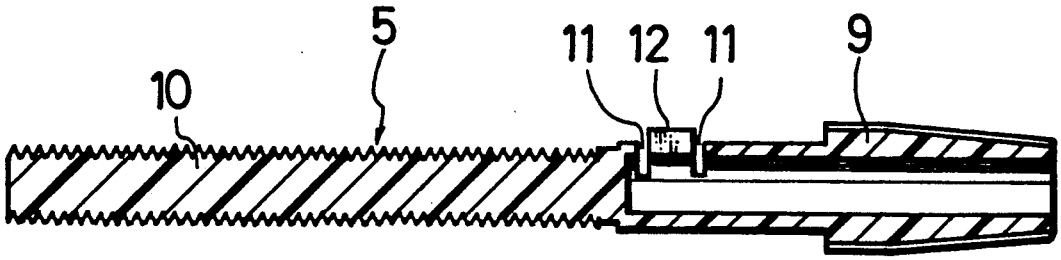
FIG. 3 is a longitudinal section of the rotatable rod of the liquid applicator.
Figure 4:
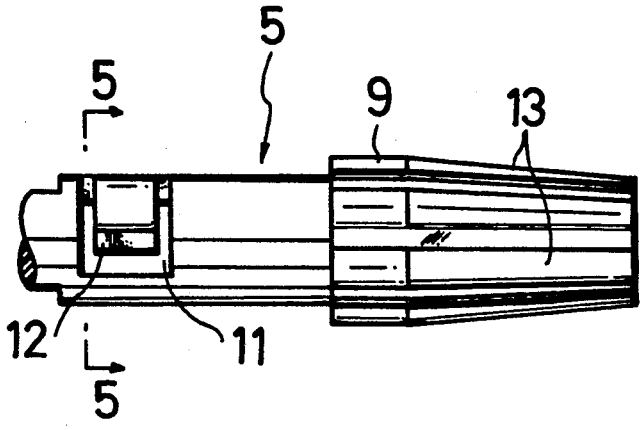
FIG. 4 is a top plan view of a fragment of the rotatable rod of the liquid applicator.
Figure 5:
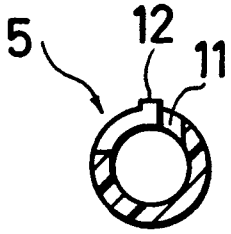
FIG. 5 is a cross section of the rotatable rod taken along the line 5—5 in FIG. 4.

As shown in FIG. 3, the rotatable rod 5 comprises a shank-and-operating end 9, and a solid rod 10 integrally connected to the cylindrical shank of the shank-and-operating end 9 and having male threads thereon. As best seen from FIGS. 3 to 7, a U-shaped slit 11 is made in the cylindrical shank of the shank-and-operating end 9 to provide a raised resilient engagement projection 12, which is adapted to be caught by the parallel grooves 18 of an anti-rotation member 6 as later described. As shown, the operating end 9 is made up by a plurality of converging split strips 13, which enclose a felt tip 14 for applying and expanding a liquid.

Figure 6:
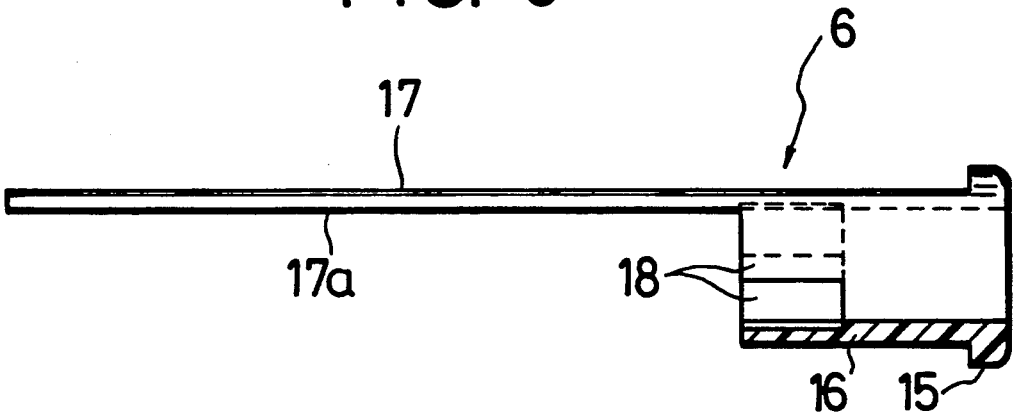
FIG. 6 is a side view of the anti-rotation member of the liquid applicator, partly in section.
Figure 7:
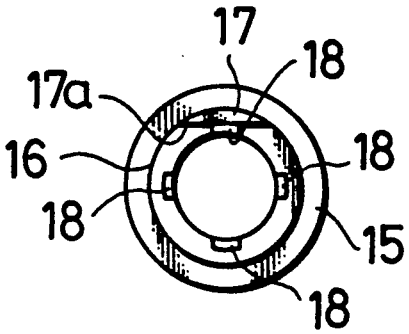
FIG. 7 is an end view of the anti-rotation member as seen from the left side of FIG. 6.

As shown in FIGS. 6 and 7, the anti-rotation member 6 has a shortened cylindrical end 16 to be fixed to the rear end of the pencil-like cylindrical body 1 and a cantilever-like extension 17 integrally connected to the shortened cylindrical end 16. The shortened cylindrical end 16 has a flange 15 integrally connected to its rear end. Also, the shortened cylindrical end 16 has a plurality of longitudinal, parallel grooves 18 made on its inner surface. The cantilever-like extension 17 has a convex-and-flat shape in cross section to permit its outer convex surface to fit the inner surface of the pencil-like cylindrical body 1 and to permit its inner flat surface 17*a* to fit the upper, flat surface 20*a* of a split slide member 7, which is later described. The anti-rotation member 6 is press-fitted in the pencil-like cylindrical body 1, and is fixed thereto by supersonic-welding its flange 15 to the rear end of the pencil-like cylindrical body 1.

Figure 8:
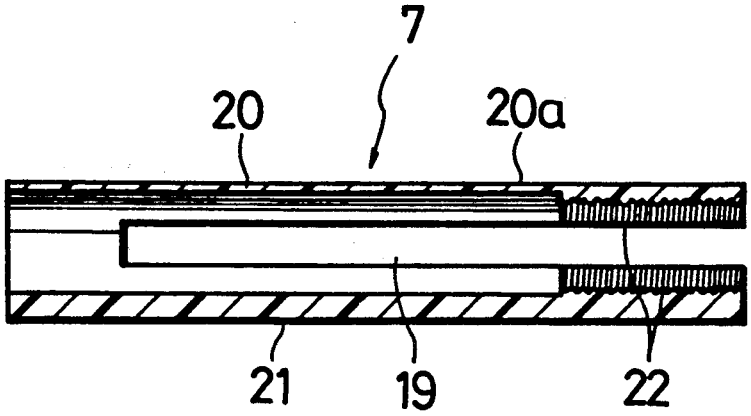
FIG. 8 is a longitudinal section of the split slide member of the liquid applicator.
Figure 9:
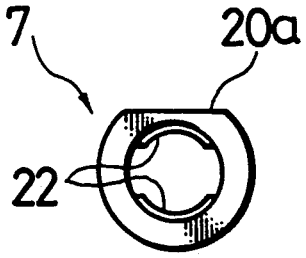
FIG. 9 is an end view of the split slide member as seen from the left side of FIG. 8.
Figure 10:
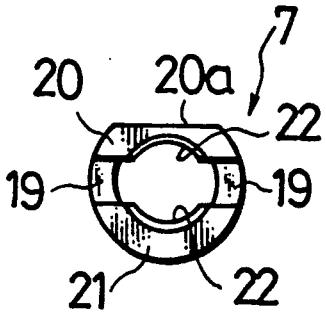
FIG. 10 is an end view of the split slide member as seen from the right side of FIG. 8.

As shown in FIGS. 8 to 10, the split slide member 7 is a hollow cylinder longitudinally split by making two opposite slots 19. The rear ends of the two split extensions 20 and 21 have female threads 22 and 22 in their inner surfaces for permitting the male-threaded rod 10 of the rotatable rod 5 to threadedly engage the split slide member 7. When the split slide member 7 and the anti-rotation member 6 are combined together, the upper, flat surface 20*a* of the split extension 20 of the split slide member 7 and the inner flat surface 17*a* of the cantilever-like extension 17 of the anti-rotation member 6 will form a complete circle of a composite body thus combined to fit in cylindrical hollow space of the pencil-like cylindrical body 1.

A piston 8 is a hollow cylindrical piece having a bottom on its end, and is slidably fitted in the pencil-like cylindrical body 1. The piston 8 will be pushed by the split slide member 7, moving forward to drive the liquid toward the application tip 2.

Specifically, the cylindrical space of the pencil-like body 1 between the pushing end 8*a* of the piston 8 and the application tip 2 is filled with liquid in the state of gel, which will be driven by the piston when the split slide member 7 is driven by the rotatable rod 5. A cap 24 is used to close the application tip 2 to keep the application tip 2 wet with liquid whereas another cap 25 is used to close the liquid expansion tip 4.

As shown in FIG. 2, the male-threaded rod 10 of the rotatable rod 5 is inserted in the shortened cylindrical end 16 of the anti-rotation member 6 until the raised resilient engagement projection 12 of the cylindrical shank of the operating end 9 has been fitted in one of the parallel grooves 18 of the shortened cylindrical end 16 of the anti-rotation member 6. The male-threaded rod 10 of the rotatable rod 5 is then inserted between the two split extensions 20 and 21 of the split slide member 7 by allowing the opposite split extensions 20 and 21 to open wide enough to permit insertion of the male-threaded rod 10 in the split slide member 7 with allowing the male threads of the male-threaded rod 10 to mate with the female threads 22 and 22 of the split slide member 7. The liquid supply assembly 4 thus assembled is fixed in the pencil-like cylindrical body 1 by welding the flange 15 of the anti-rotation member 6 to the rear end of the pencil-like cylindrical body 1.

In use, the cap 24 is removed to expose the application tip 2, and the operating end 9 of the rotatable rod 5 is rotated to drive the split-slide member 7 without permitting rotation of the split-slide member 7. Rotation of the split-slide member 7 is prevented by the cantilever-like extension 17 of the anti-rotation member 6. Thus, the piston 8 pushes the liquid L with its pushing surface 8*a* in the pencil-like cylindrical body 1. The liquid under pressure passes through the fine liquid passage or channel 3 of the application tip 2. Thus, the liquid applicator is ready for application of the liquid, such as rouge to lips.

The resiliency of the raised piece 12 allows the raised piece 12 to fit in the longitudinal parallel slots 18 one after another when the rotatable rod 5 is rotated in one direction, thereby assuring a stable stop of the rotatable rod 5 every time the raised piece 12 is fitted in a selected parallel slot 18.

FIGS. 11 to 15 show different modifications of application tips suitable for use in applying controlled quantities of liquids of different viscosities.

Figure 11:
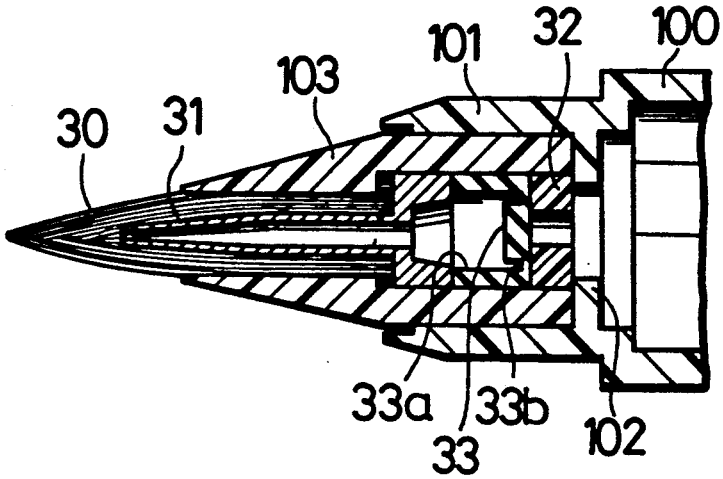
FIG. 11 shows, partly in section, a modification of application tip.

FIGS. 11 shows the liquid-application end 100 of a pencil-like cylindrical body 1 as having an annular extension 101 of a reduced diameter corresponding to the inner diameter of the cap 24, having an annular stopper 102 integrally connected to the inner surface of the small-to-large diameter transient portion of the annular extension 101. A tapered metal mount 103 for an application tip 30 is press-fitted in the annular extension 101. The application tip 30 in the form of brush has a nozzle 31 along its longitudinal axis. A rubber valve 33 is laid on a center-apertured washer 32 between the nozzle 31 and the stopper 102 to control the opening and closing of the center aperture of the washer 32. Specifically, the valve 33 is circular, and is connected by a plurality of strips 33*b* extending from a rubber cylinder 33*a*. Thus, the valve 33 is responsive to the liquid under pressure for opening.

The application tip of FIG. 11 is appropriate for the purpose of applying a liquid of low and medium viscosity. When the liquid supply assembly 4 drives the liquid L to push and raise the valve 33, the liquid flows in the nozzle 31 to ooze in the brush 30. When no pressure is applied, the valve 33 is closed to prevent the flowing of the liquid, guaranteed free of the undesired oozing from the application tip even if the liquid is of low viscosity.

Figure 12:
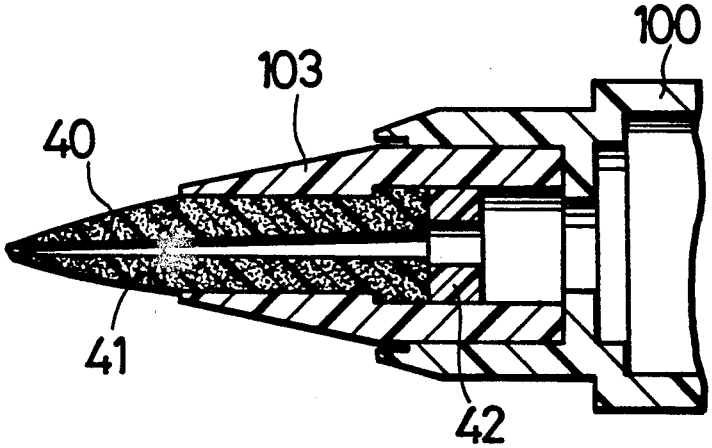
FIG. 12 shows, partly in section, a modification of application tip.

FIG. 12 shows an application tip 40 of silicone resin or urethane, and having a liquid passage or channel 41 along its longitudinal axis. The rear end of the application tip 40 abuts on a washer 42. This liquid applicator is appropriate for the purpose of applying a liquid of medium and high viscosity, which can pass through the channel 41 to ooze from the brush tip 40.

Figure 13:
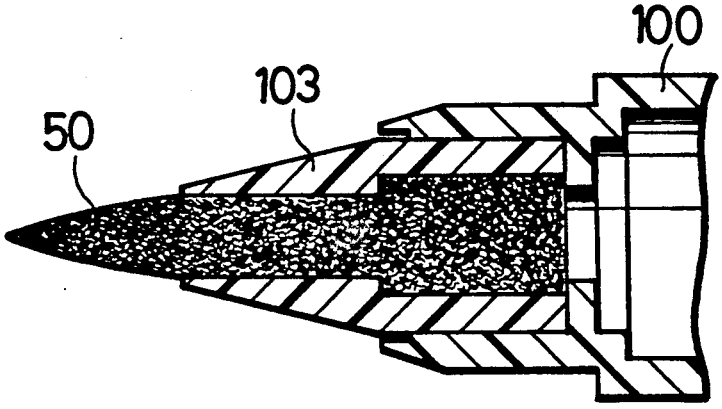
FIG. 13 shows, partly in section, still another modification of application tip.

FIG. 13 shows an application tip 50 of nylon filaments, which are of increased density and decreased infiltration. The substantial length of the nylon application tip is press-fitted in the mount piece 103 with its rear end laid across the center aperture of the annular stopper 102.

A liquid applicator using this nylon application tip 50 is appropriate for the purpose of applying a liquid of low viscosity, which can easily ooze from the brush tip 50. It, however, can hold liquid to prevent the excessive oozing from the brush tip 50.

Figure 14:
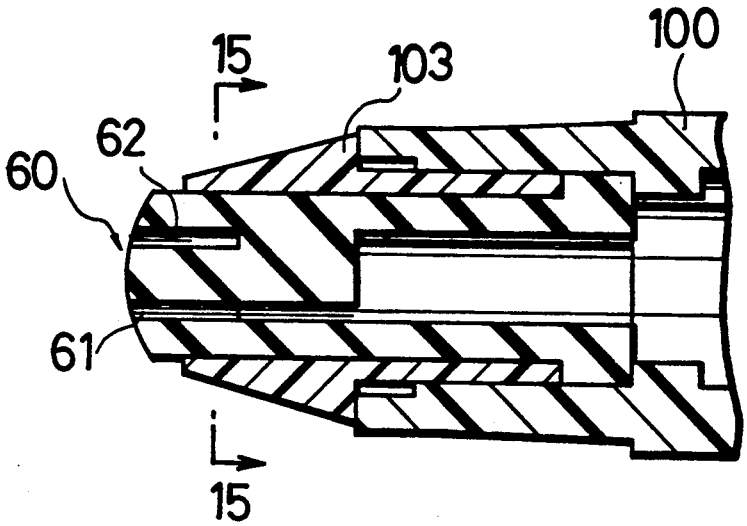
FIG. 14 shows, partly in section, still further modification of application tip.
Figure 15:
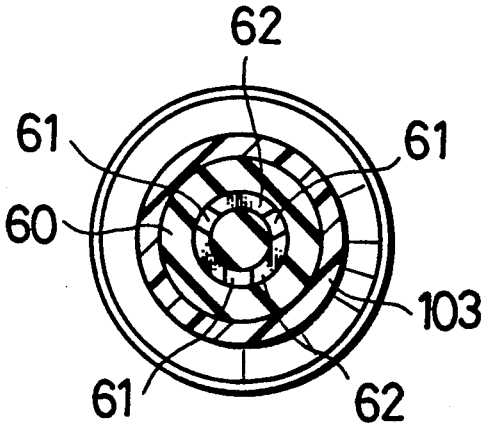
FIG. 15 is a cross section of the application tip taken along the line 15—15 in FIG. 14.

FIGS. 14 and 15 show an application tip 60 of a soft resin material such as silicone rubber, and having a round tip and three through apertures 61 made in a circular circumference on the round tip and arc slots 62 communicating with the through apertures 61, leaving a cylindrical portion at its center.

This liquid applicator is appropriate for applying a liquid of medium or high viscosity. The arc slots 62 can store liquid enough to permit application of liquid to a relatively large area, for instance body-painting.

Liquid applicators according to the present invention can be used in applying cosmetics, or other liquids such as erasing liquid.

As may be understood from the above, the liquid applicator structure of the present invention permits: the oozing of a controlled quantity of liquid from the application tip simply by rotating the rotatable rod, thus facilitating use of the liquid applicator; the designing of liquid applicators appropriate for the application of liquids of low, medium and high viscosities; a pleasing designing of liquid applicators as preferable for cosmetic articles; and the easy assembling of all parts, advantageous for mass production.

We claim:

1. A liquid applicator, comprising:

a cylindrical body;

an application tip fixed to a front end of said cylindrical body; and a liquid supply assembly connected into a rear end of said cylindrical body, said cylindrical body being filled with a liquid to be applied between said application tip and said liquid supply assembly, said liquid supply assembly including a rotatable rod having a cylindrical shank-and-operating end and a solid rod integrally connected thereto and having male threads thereon, an anti-rotation member having a shortened cylindrical end fixed to the rear end of said cylindrical body and a cantilever-like extension integrally connected to the shortened cylindrical end, means for permitting said rotatable rod to rotate only in one direction, including a plurality of longitudinal parallel slots made in the shortened cylindrical end, and a resiliently raised piece integrally connected to the cylindrical shank of the rotatable rod such that the raised piece resiliently fits in the longitudinal parallel slots one after another when the rotatable rod is rotated in one direction, preventing the rotatable rod from rotating in the other direction, a split slide member having two split extensions whose rear ends have female threads in their inner surfaces, one of the two split extensions being inserted in the cantilever-like extension of the anti-rotation member and the rotatable rod so as to prevent the split slide member from rotating, and a piston member abutting on the split slide member, wherein rotation of the rotatable rod caused the split slide member, and hence the piston to advance and drive the liquid toward said application tip.

2. A liquid applicator according to claim 1 wherein one of the two split extensions has a flat surface on its outside and the extended cantilever strip of the anti-rotation member has a flat surface on its inside.

3. A liquid applicator according to claim 1, wherein said application tip is a brush having a fine tube nozzle and a valve fixed to the rear end of the tube nozzle, said valve being responsive to pressure applied by the split slide member via the liquid for opening and causing liquid to flow into the fine tube nozzle.

4. A liquid applicator according to claim 1, wherein said application tip is made from at least one of silicone resin and urethane, and has a channel therein.

5. A liquid applicator according to claim 1, wherein said application tip is made from a soft resin material such as silicone rubber, and has a round tip and at least one through aperture made in a circular circumference on the round tip and arc slots communicating with the through aperture, defining a cylindrical portion at its center.

* * * * *